United States Patent [19]

Saby et al.

[11] Patent Number: 4,907,675

[45] Date of Patent: Mar. 13, 1990

[54] MODULAR CONSTRUCTIONAL ELEMENT IN PARTICULAR OF A LADDER OR SCAFFOLDING

[76] Inventors: Gérard Saby, Hameau d'Auffray - Oherville 76560, Doudeville; Frédéric Lemercier, Résidence Ecureuil - 11 rue d'Arques, 76190 Yvetot, both of France

[21] Appl. No.: 205,248

[22] Filed: Jun. 10, 1988

[30] Foreign Application Priority Data

Jun. 11, 1987 [FR] France ..... 87 08153
Feb. 9, 1988 [FR] France ..... 88 01529

[51] Int. Cl.[4] ..... E06C 1/10; E06C 1/18

[52] U.S. Cl. ..... 182/178; 182/107; 182/104; 182/120

[58] Field of Search ..... 182/178, 120, 107, 104

[56] References Cited

U.S. PATENT DOCUMENTS

| | | | |
|---|---|---|---|
| 349,049 | 9/1886 | Lippincott | 182/178 |
| 724,953 | 4/1903 | Schaller | 182/178 |
| 2,201,608 | 5/1940 | Causey | 182/178 |
| 3,476,211 | 11/1969 | Cormier | 182/178 |
| 3,747,689 | 7/1973 | Frederick | 182/178 |
| 4,086,980 | 5/1978 | Shortes | 182/178 |

FOREIGN PATENT DOCUMENTS

| | | | |
|---|---|---|---|
| 485108 | 9/1969 | Switzerland | 182/120 |

*Primary Examiner*—Reinaldo P. Machado
*Attorney, Agent, or Firm*—Sughrue, Mion, Zinn, Macpeak & Seas

[57] ABSTRACT

This modular constructional element (14), which is of the type comprising at least two uprights between which at least one crosspiece extends, is such that each end of the uprights is screw-threaded and adapted to cooperate with a fixing ring (18, 19) for fixing the element (14) to an adjacent means (15).

25 Claims, 11 Drawing Sheets

MODULAR CONSTRUCTIONAL ELEMENT IN PARTICULAR OF A LADDER OR SCAFFOLDING

The present invention relates to a modular constructional element in particular of a ladder or scaffolding.

A number of modular elements of this type are already known in the art. These elements usually comprise at least two uprights between which at least one crosspiece extends, the ends of the uprights being adapted to cooperate with the corresponding ends of the uprights of the adjacent elements in order to fix the elements together.

These elements, which are usually capable of being fitted one inside the other and locked in position, permit the construction of single ladders, double ladders and even scaffolding from modular elements the transport and storage of which are relatively easy.

However, presently-known ladders in no way permit the assembly to the desired dimensions by the users.

Furthermore, they are of limited use owing to the diversity of the length and shape of the elements forming part of their construction.

Another problem also exists which resides in the interlocking of the elements. Various devices, such as pins or clamping means, have been employed for this function.

However, these various devices present a number of drawbacks, in particular as concerns their reliability, their complexity in utilization, and their manufacturing cost.

Furthermore, there is also known from the document FR. 2 337 802 a scaffolding having elements capable of being fitted together, characterized in that it comprises two elements interconnected end-to-end by a detachable coupling comprising at the end of the first of the elements in question, a socket which receives in a disengageable manner the end of the second element, and a collar rotatively mounted on said second element and screw-threadly engaged on the element forming a sleeve and which, when the screw-threaded engagement of the collar with the sleeve is tightened, urges the second element toward the first element.

This assembly presents a number of drawbacks. Indeed, the screwing collar is maintained on one of the elements by means of a boss provided on this element. Consequently, it is impossible to disengage this collar from the element without damaging either one thereof. Now, this feature is of particular importance in the concerned field, in that this type of equipment often undergoes deteriorations which may be for example in the form of mechanical deformations. It is therefore important to be in a position to easily disassemble these component parts, which are particularly liable to this type of deterioration, for replacing, cleaning or storing them.

An object of the invention is therefore to solve these problems by proposing a modular constructional element which is simple, reliable, cheap, easy to maintain and permits obtaining any form of ladder or scaffolding, while conforming to the standards in force in this type of equipment.

The invention therefore provides a modular constructional element, in particular a ladder or scaffolding, of the type comprising at least two uprights between which at least one crosspiece extends, wherein each end of the uprights is provided with a screw-thread and adapted to cooperate with a fixing ring for fixing said element to at least one adjacent means.

According to another aspect, the invention also provides a single ladder which comprises at least two elements such as that previously described.

According to a further aspect, the invention also provides a multiple ladder which comprises at least two single ladders such as that previously described, interconnected in their upper part by articulation means.

According to yet another aspect, the invention also provides a scaffolding which comprises two vertical upright planes and a substantially horizontal work plane, constituted by elements such as those previously described and interconnected by articulation means.

A better understanding of the invention will be had from the following description which is given solely by way of example with reference to the accompanying drawings, in which:

FIG. 1 is a front elevational view of a first embodiment of a modular element according to the invention;

FIG. 2. is a front elevational view of a second embodiment of a modular element according to the invention;

Figure 1:
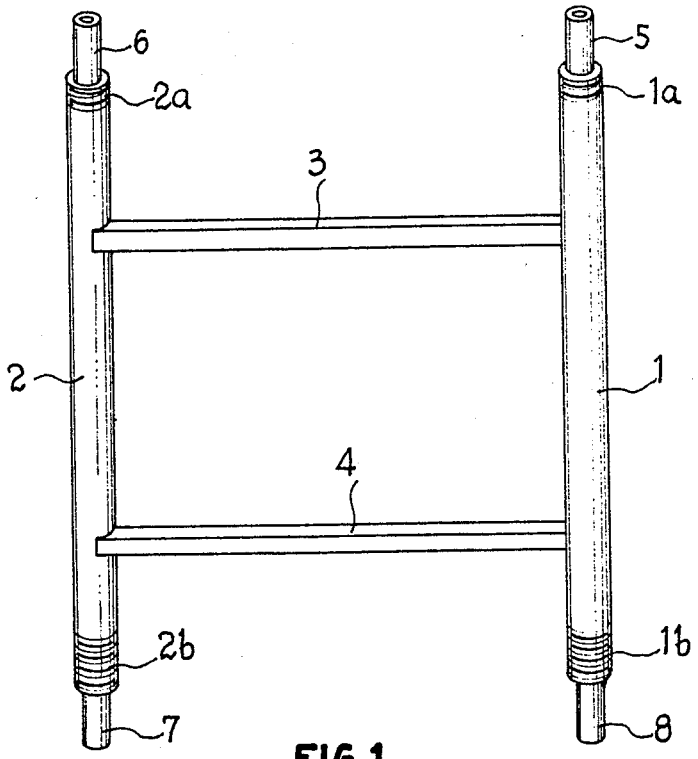

As can be seen in FIG. 1, a modular constructional element according to the invention comprises at least two uprights 1, 2 which are for example parallel and between which at least one crosspiece 3 extends.

In the illustrated embodiment, a second crosspiece 4 parallel to the first one extends between the two uprights 1 and 2.

Uprights are shown in this Figure which have a circular section and crosspieces are shown to have a square section. However, it will be understood that other sections may be envisaged.

As is shown, the ends of the uprights have screw-threaded portions, respectively 1*a*, 1*b* and 2*a*, 2*b*, which, as will be seen hereinafter, are adapted to cooperate with the inner screw-thread or tapping of a connecting ring for connecting the modular element to at least one adjacent means.

Spigots 5, 6, 7 and 8 are also provided at each end of the uprights. These spigots are for example adapted to cooperate with cavities of corresponding shape provided in the ends of the adjacent elements or means to ensure a correct centering and positioning between the various elements or adjacent means.

These spigots may have for example a cylindrical or frustoconical shape.

The use of frustoconical spigots adapted to cooperate with cavities of complementary shape has the advantage of taking up clearances in the region of the connections between the elements, it being understood that these clearances could result in a large deflection of assemblies of large size.

Figure 2:
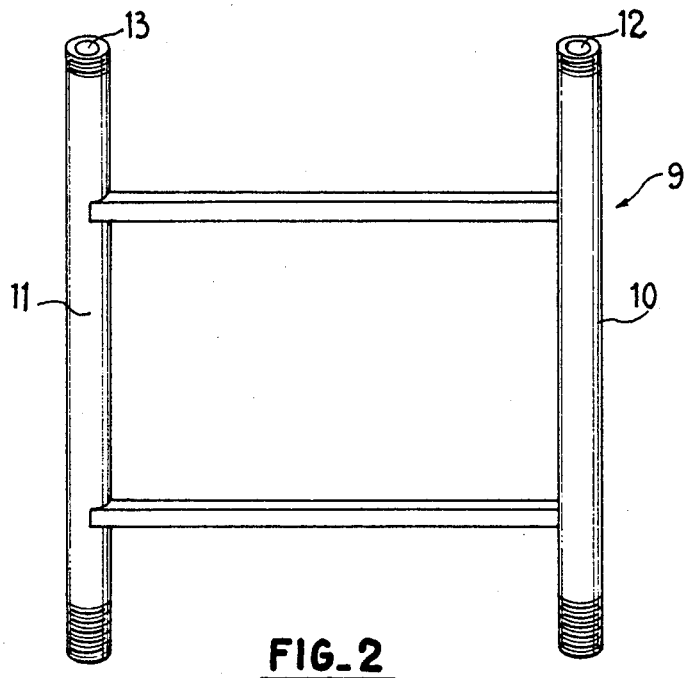

An embodiment of an adjacent element is shown in FIG. 2 which shows that the element 9 comprises uprights 10 and 11 each having at their ends cavities for example 12 and 13 for receiving the spigots of the ends of the element shown in FIG. 1.

Figure 3:
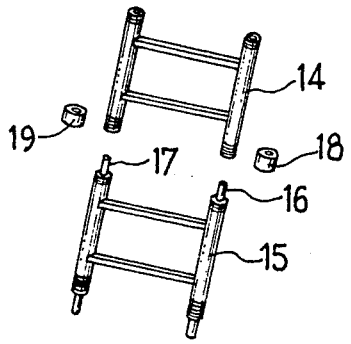
FIG. 3 is an exploded view of a portion of a ladder or scaffolding comprising two elements according to the invention.

The fixing together of two adjacent elements is illustrated in FIG. 3, which shows two modular elements 14 and 15 of different design, the spigots 16 and 17 of the modular element 15 being engaged in corresponding cavities of the ends of the uprights of the element 14, while rings 18 and 19 are screwed on the corresponding screw-threaded portions of the two elements so as to interlock the two elements in position.

In this respect, it will be observed in the drawings (e.g. at 2*b* and 1*b* of FIG. 1) that the length of the screw thread on at least one end of the uprights is long enough to allow the fixing ring 18 and 19 to be completely screwed onto this end to permit the assembly of two adjacent elements and, if desired, an abutment of the ends of their uprights before screwing the ring onto the end of the upright of the adjacent element (by partly unscrewing it from the upright of the other element). The other end of the uprights may have a shorter screw thread (e.g. as shown at 1*a* and 2*a* in FIG. 1) so that the fixing ring 18 or 19 may be jammed against the end of the screw thread when the ring has been screwed thereon to the extent of substantially one half of the length of the ring so as to fix this ring in position.

It will be understood that such locking by screwing the rings on the screw-threaded portions of two adjacent elements is extremely reliable in that the unlocking can only be achieved by the unscrewing of these rings, which precludes any unintentional unlocking, which could occur with the devices of the prior art employing for example a pin.

It will be understood that means for locking the ring in position may also be provided, such as pins extending through orifices provided in the ring and in the corresponding upright of a modular element.

Figure 4:
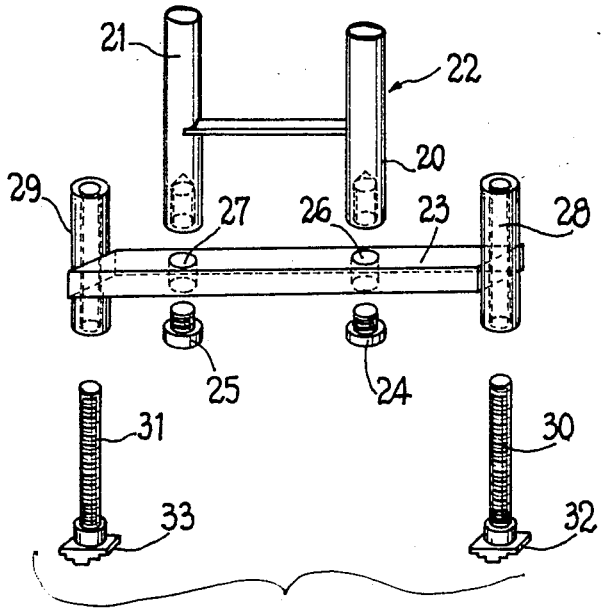
FIG. 4 is an exploded view of an embodiment of foot means which are part of the construction of a ladder or scaffolding according to the invention.

Thus it is possible to associate a plurality of modular elements one above the other to form for example a single ladder. In this case, a good bearing on the ground should be ensured in the lower part of the latter. This may be achieved, for example, by foot means such as those shown in FIG. 4, in which are shown the lower ends of the uprights 20 and 21 of a modular element 22 which are fixed to a support bar 23 by means of bolts 24, 25 extending through orifices 26 and 27 provided in the bar 23 and cooperating with a screw-threaded or tapped cavity provided in the lower ends of the uprights 20 and 21.

It will be understood that these tapped cavities may be provided in intermediate rings screwed on the uprights of an element identical to that shown in FIG. 2.

The support bar 23 has, for example, at each of its ends, a tubular sleeve 289, 29 which has an internal screw thread and is adapted to cooperate with a screw-threaded rod 30 and 31 having in its lower part a support shoe 32 and 33 of known type and adapted to ensure good stability of the assembly on the ground. Note moreover that actuating means, such as for example a crank, may be provided in the upper part of the screw-threaded rods 30 and 31.

Figure 5:
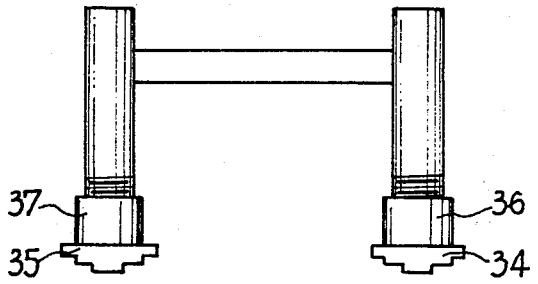
FIG. 5 is a view illustrating the fixing of non-slip shoes on a modular element according to the invention.

It should also be noted that the foot means may be formed by shoes 34 and 35 (FIG. 5) fixed by means of rings 36 and 37 on the lower part of the uprights of an element. These shoes may for example be articulated in the known manner on the rings to ensure a good support irrespective of the configuration of the ground.

Figure 6:
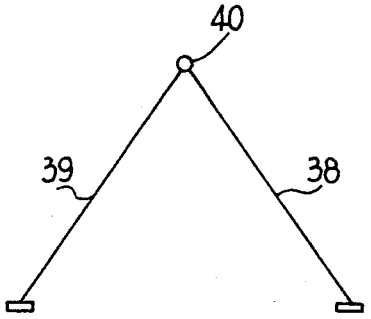
FIG. 6 is a view of a double ladder.

The elements just described may also be part of the construction of a double ladder, such as that shown in FIG. 6 which comprises two planes 38 and 39 interconnected in their upper part by articulation means 40. These articulation means may for example occupy four stable positions such as those illustrated in FIG. 7 in which it can be seen that the articulation means 40 comprise an articulation proper 41 which will be described in more detail hereinafter and two fixing branches 42, 43 adapted to cooperate with fixing rings and corresponding ends of the uprights of the elements. Indeed branches have screw-threaded portions 42*a* and 43*a* respectively, and centering spigots 42*b* and 43*b* for the fixing and centering thereof.

Figure 7:
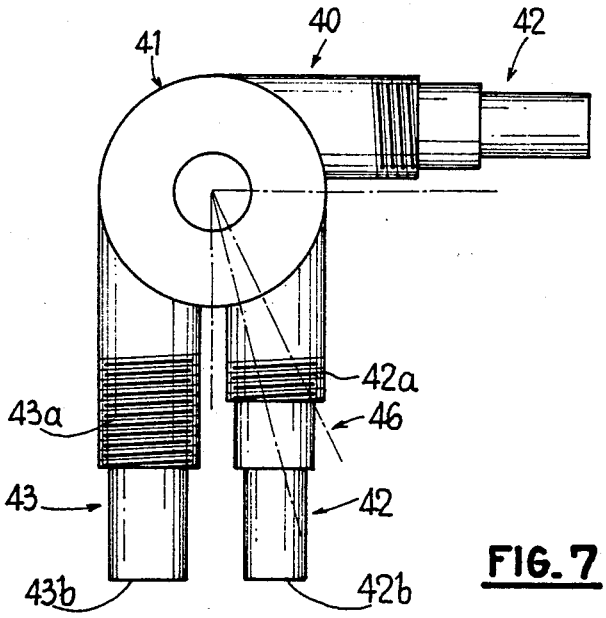
FIG. 7 is a view illustrating the various positions that the articulation means which are part of the construction of a double ladder or a scaffolding according to the invention are capable of occupying.

As illustrated in FIG. 7, the two branches 42 and 43 may make angles of 0°, 15°, 25° or 90° therebetween. The position in which the two branches are parallel to each other corresponds for example to the storage position of the double ladder. The positions in which the two branches of the articulation means 40 make angles of 15° or 25° therebetween correspond to standard positions as concerns double ladders and the position at 90° corresponds, as will be seen hereinafter, to a utilization in a scaffolding.

Figure 8:
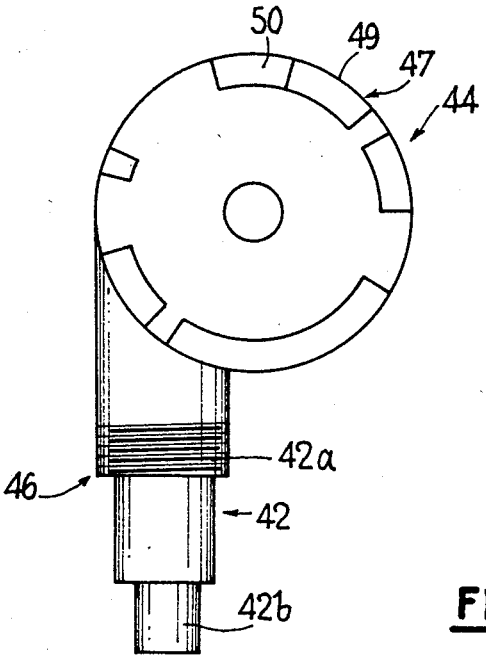
FIG. 8 is a front elevational view of a first half -shell which is part of the construction of the articulation means shown in FIG. 7.
Figure 9:
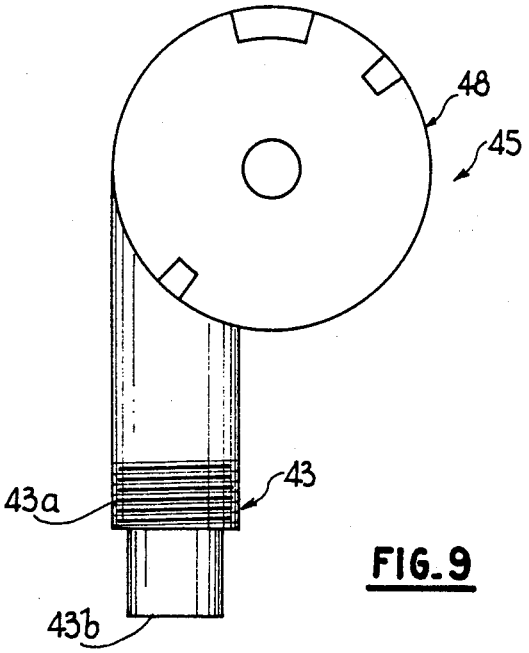
FIG. 9 is a front elevational view of a second half-shell which is part of the construction of the articulation means shown in FIG. 7.

These articulation means may be constituted by two half-shells 44 and 45 illustrated in FIGS. 8 and 9 respectively. These two half-shells have two branches 42 and 43 respectively described with respect to FIG. 7. However, it should be noted that the branch 42 includes a shoulder 46 whose function will be described hereinafter.

The half-shells 44 and 45 comprise plates 47 and 48 respectively, rotatively mounted on each other, and including projecting portions and recesses which are adapted to cooperate with one another for the purpose of determining the aforementioned four stable positions. It will be understood that these projecting portions and recesses may have different configurations to obtain these different stable positions or other stable positions.

However, note that one of the projecting portions provided on the plate 47 of the half-shell 44, and more particularly the projecting portion 49, includes a portion 50 whose height is less than that of the other projecting portions, the function of this portion 50 being described in more detail hereinafter.

Figure 10:
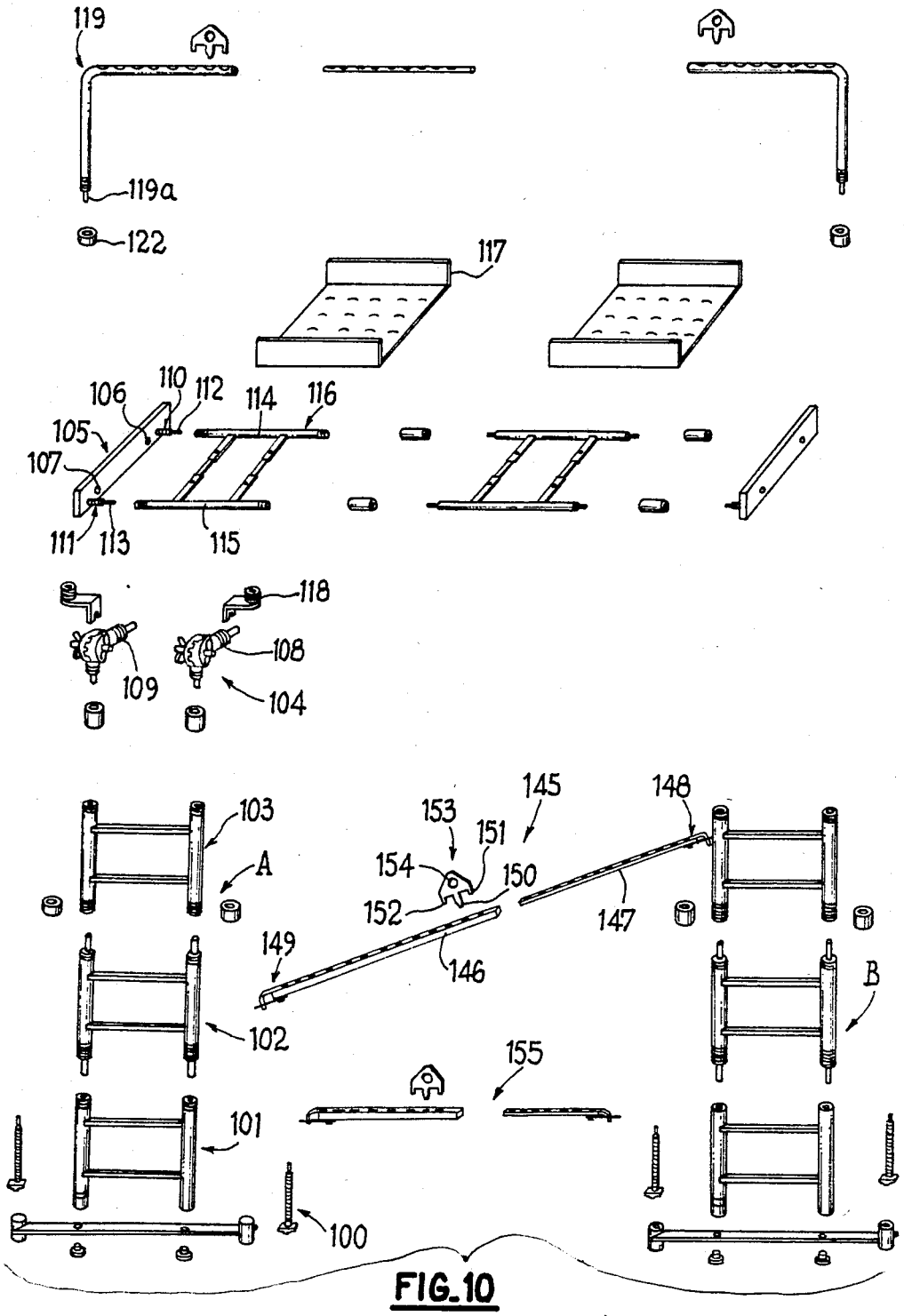
FIG. 10 is an exploded view of a scaffolding according to the invention.

As shown in FIG. 10, the modular elements, the articulation means and the foot means just described may be part of the construction of a scaffolding.

FIG. 10 shows the foot means 100 fixed in the lower part of an element 101 constituting with the elements 102 and 103 a lateral ladder A of a scaffolding. In the upper part of the ladder, there are provided articulation means 104 such as those described with reference to FIGS. 7, 8 and 9 whereby it is possible to fix in a substantially horizontal plane a work platform. A second ladder B is provided at the other end of the work platform.

Figure 12:
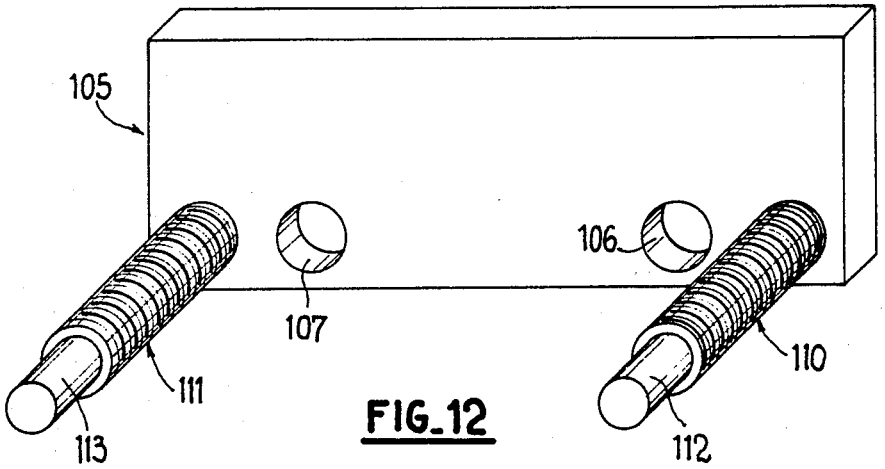
FIG. 12 is a perspective view of an adaptation plate which is part of the construction of a scaffolding according to the invention and permits adapting a platform which has a standard work width on the rest of the scaffolding.

This work platform comprises an adaptation plate 105 (shown in more detail in FIG. 12) including two openings 106, 107 in which are engaged the screw-threaded portions 108 and 109 of articulation means 104. These screw-threaded portions project on the other side of the plate in order to permit the fixing of the plate on the articulation means by means of rings or nuts, the step of the corresponding branch of the articulation means, similar to the step 46 (FIG. 8), abutting against the edge of the corresponding opening of the plate. The adaptation plate also includes two screw-threaded pins 110 and 111 including spigots 112 and 113 adapted to engage in cavities provided in the corresponding ends of the uprights 114 and 115 of a support element 116 of the floor of the work platform. Note that the distance between the pins 110, 111 corresponds for example to a standard with as concerns work platforms for scaffolding.

The elements, for example 116, carrying the floor of the work platform of the scaffolding may have a general structure similar to the previously-described elements. However, it should be noted that the latter may have telescopic crosspieces which will be described in more detail hereinafter, in order to adapt the distance between the uprights of these elements and therefore the width f the work platform. Modular floor elements 117 which will be described in more detail hereinafter may be disposed on these elements, for example the elements 116.

Fixing members 118 may also be provided in the region of the articulation means 104 for fixing means constituting guard-rails 119 on each side of the work platform.

Figure 11:
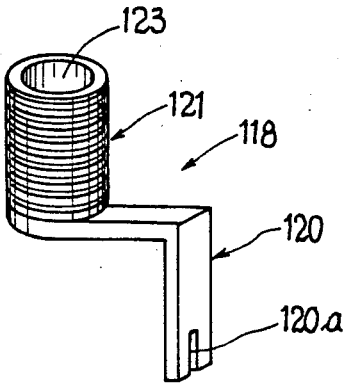
FIG. 11 is a perspective view of a fixing member of means constituting a guard-rail which is part of the construction of a scaffolding according to the invention, on the rest of the scaffolding.

A fixing member 118 is shown in more detail in FIG. 11. This fixing member 118 has a first portion 120 adapted to be engaged between the two half-shells of the articulation means 104 in the region of the portion corresponding to the portion 50 of the articulation means (FIG. 8). This first portion 120 has a slot **120*a* adapted to be engaged for example on the articulation pin of the articulation means 104. The fixing member 118 also includes a second portion 121 which is screwthreaded and adapted to cooperate with a ring 122 (FIG. 10) for fixing the means 119** forming a guard-rail on the articulation means.

The fixing member 118 (FIG. 11), and more particularly the second portion 121 of the latter, may also include a cavity 123 adapted to receive a spigot **119*a* (FIG. 10) of the means constituting a guard-rail 119** so as to improve the safety of the assembly.

Also note that the adaptation plate 105 has such height that at least one portion of the latter projects above the surface of the floor of the work platform so as to constitute a ledge at each end of the work platform also for improving the safety of the assembly.

Figure 13:
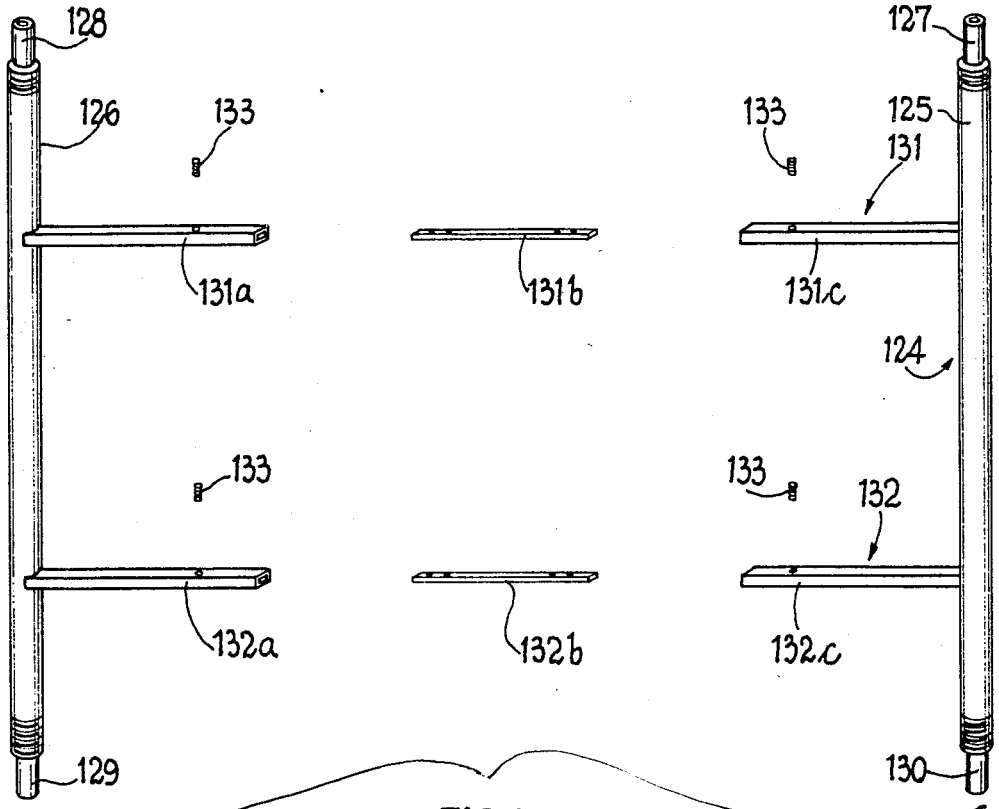
FIG. 13 is an exploded view of a first embodiment of a modular element which is part of the construction of a support floor of the work platform of the scaffolding.
Figure 14:
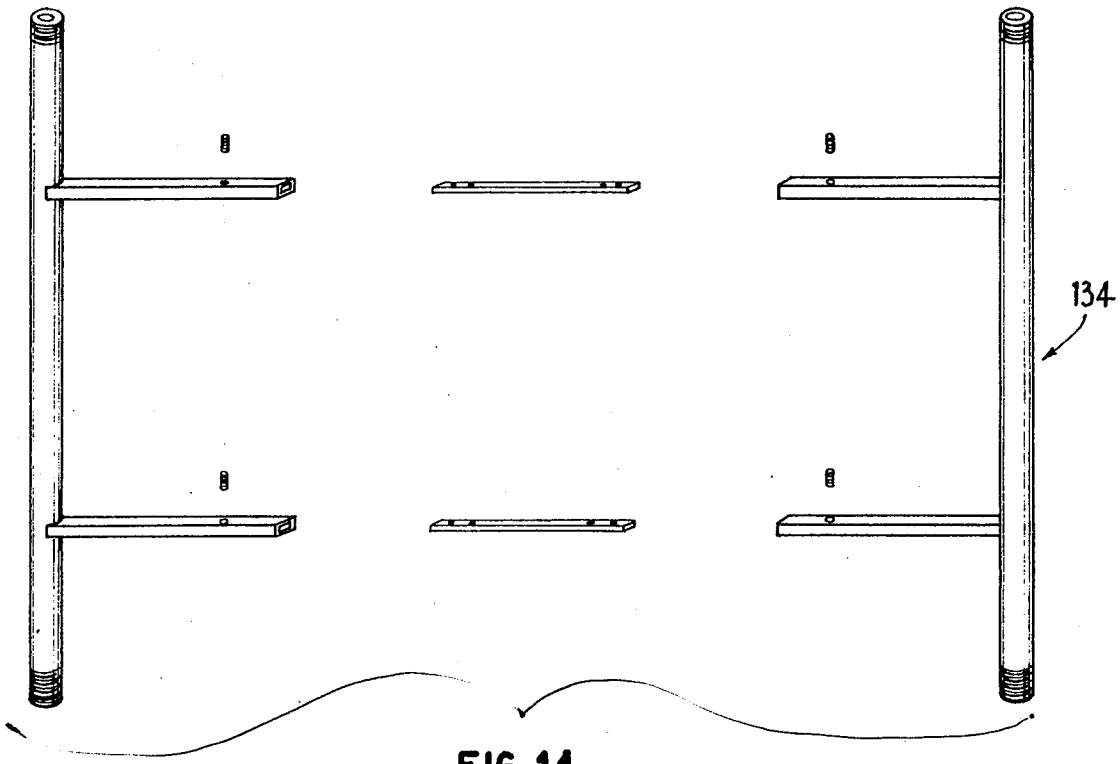
FIG. 14 is a view of a second embodiment of the modular element which is part of the construction of a support floor of the work platform of the scaffold.

FIGS. 13 and 14 show two different embodiments of support elements for the floor of the work platform. These elements, which have a structure for fixing them to each other, identical to that of the elements described with reference to FIGS. 1, 2 and 3, have crosspieces whose length is adjustable in order to permit an adaptation of the distance between the uprights of the elements whereby to adapt the width of the support of the floor to the standards in force in this field.

Thus, for example, there is shown in FIG. 13 an element 124 whose uprights 125 and 126 have screw-threaded ends and include centering spigots 127, 128, 129, 1130. The crosspieces 131 and 132 of the element 124 are formed by three portions **131*a*, 131*b*, 131*c* and 132*a* 132*b* 132*c* respectively, the portions 131*b* and 132*b* being capable of fitting in the portions 131*a* 131*c* and 132*a*, 132*c* respectively for adapting the distance between the uprights to the requirements of the user. Locking means, such as for example screws 133, are provided in each portion 131*a*, 131*c* 132*a* 132*c* for locking the various portions in position. FIG. 14 shows an element 134 whose uprights are similar to those of the element described with reference to FIG. 2, i.e. these uprights have at each of their ends a cavity for receiving spigots of complementary elements whose crosspieces are similar to those of the element just described with reference to FIG. 13. The element shown in FIG. 14** will not be described in more detail.

Figure 15:
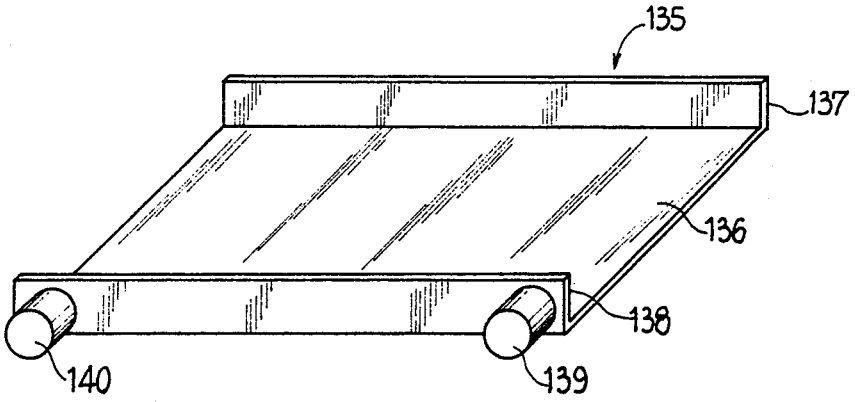
FIG. 15 is a perspective view of a first embodiment of a floor element which is part of the construction of a work platform of a scaffolding according to the invention.

The modular floor elements such as the element 117 shown in FIG. 10 may be constituted by elements such as that shown in FIG. 15. This element 135 has a support surface 136 and two lateral flanges 137 and 138.

According to one embodiment, the positioning of this element 135 on the support elements is ensured by means of the lateral projecting portions 139 and 140 which bear against the uprights of the corresponding support elements.

Figure 16:
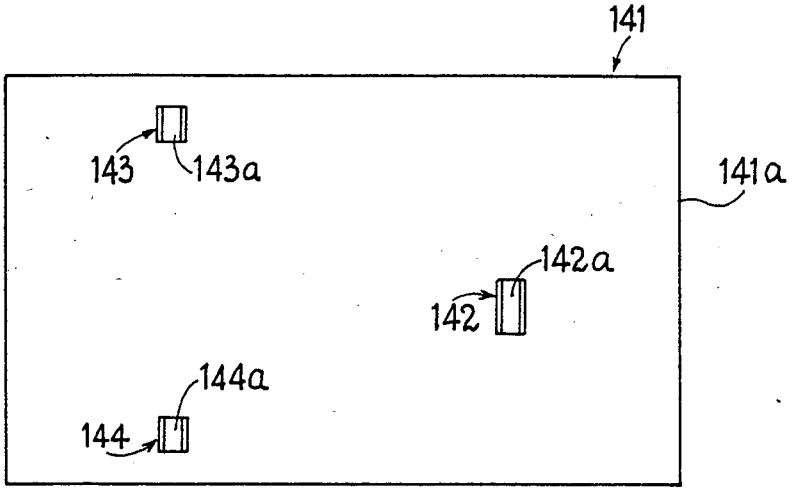
FIG. 16 is a bottom view of a second embodiment of a floor element which is part of the construction of a work platform of a scaffolding according to the invention.
Figure 17:
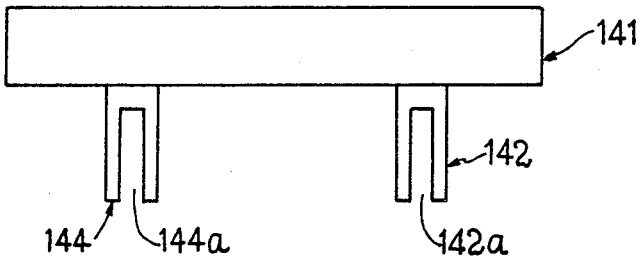
FIG. 17 is a side elevational view of the element shown in FIG. 16.

However, these floor elements may also be formed by the elements such as that shown in FIGS. 16 and 17, in which the floor element 141 includes centering spigots 142, 143, 144 fixed to the lower surface of the support part **141*a*, these spigots including slots 142*a*, 143*a*, 144*a*** respectively, adapted to be engaged on the crosspieces of corresponding support elements.

Note that the spigots 143, 144 (FIG. 16) are symmetrically arranged on each side of the longitudinal axis of the floor element, and the element 142 is disposed on one side of this axis so as to always bear against one of the portions **131*a* 131*c* 132*a* 132*c* of the crosspieces of the elements described with reference to FIG. 13 or 14**, so as to always obtain a correct positioning of the corresponding floor element.

Indeed, the portion **131*b*, 132*b* (FIG. 13) of the crosspieces has a section of smaller dimension than the portions 131*a*, 131*c*, 132*a*, 132*c*** which would have an adverse effect on the stability of the corresponding floor element if the latter bore against this crosspiece portion.

It will be understood that the upper surface of the floor elements may have any suitable means whereby to impart thereto certains non-slip properties to improve the safety of the users.

Returning to FIG. 10, it cn be seen that rigidifying means 145 are provided between the lateral ladders A and B of the scaffolding. These means are advantageously formed by two tubular members 146 and 147 which are telescopically inserted one inside the other and have at each end fixing means 148, 149 for fixing to the lateral ladders. The members 146 and 147 advantageously have on their upper and lower surfaces corresponding apertures adapted to cooperate with claws 150, 151 and 152 of a locking member 153. This locking member locks the relative positions of the two members 146 and 147 when the scaffolding is assembled, so as to impart to the later enhanced stiffness or rigidity. Note that the member 153 has for example an orifice 154 which facilitates the gripping of the member 153 by the user and that it may also include means for locking it in position, for example constituted by a pin or a screw.

This type of member 153 may also be used for locking in position the means constituting a guard-rail when the latter are telescopic so as to adapt their length to the length of the scaffolding.

A stabilizing bar 155 of structure similar to the means 145 may also be provided in the lower part of the scaffolding.

Furthermore, the means forming the guard-rail 119 may be for example constituted by a hand-rail as shown in FIG. 10 or by any other standard guard-rail whose fixing means are also formed by a screw-threaded portion and a ring adapted to cooperate with a screw-threaded portion of a fixing member 118 of these means forming a guard-rail on the articulation means and therefore on the rest of the scaffolding.

It will of course be understood that the various previously described elements and means may be made from any suitable material, such as for example aluminium.

Figure 18:
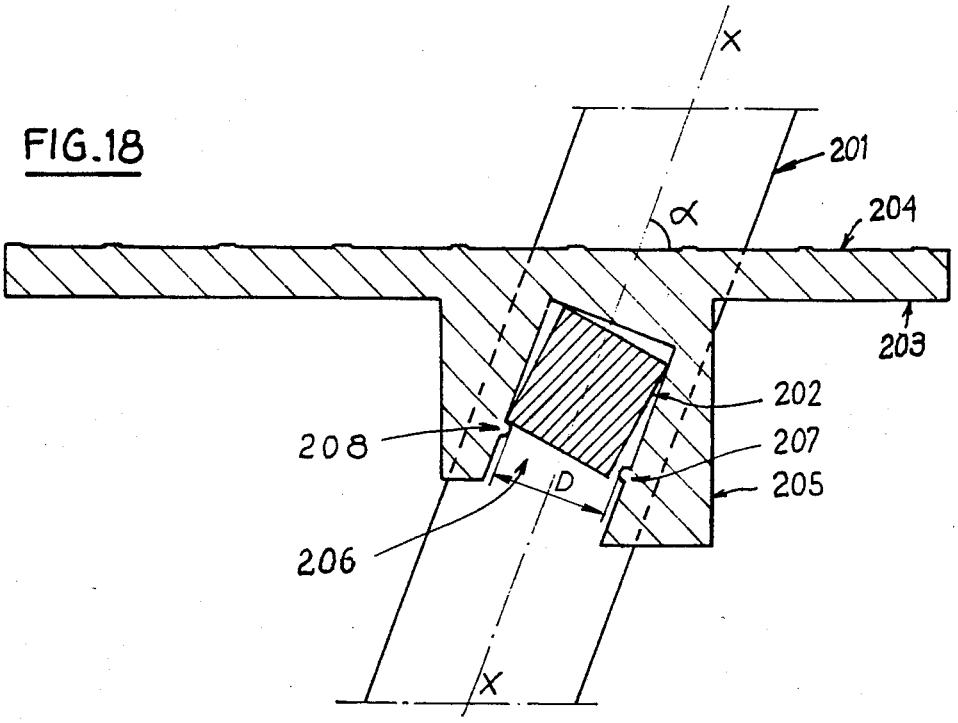
FIGS. 18, 19 and 20 are different views of a detachable step adaptable on a crosspiece of an element according to the invention.

As can be seen in FIG. 18, a detachable step may also be disposed on a crosspiece, for example of a ladder of the type comprising two uprights only the upright 201 of which is shown in this Figure, between which uprights at least one crosspiece 202 extends, this crosspiece having for example a non-circular section, such as a square section as shown in FIG. 18. The step 203 includes a support surface 204 for the user, under which there is provided a base 205 for fixing the step to the crosspiece 202 of the ladder. This base advantageously includes a slot 206 for receiving the crosspiece 202 of the ladder.

In this embodiment, the slot 206 has a width slightly greater than the width of the crosspiece 202 of the ladder so as to permit the engagement of the base around this crosspiece and a locking against rotation of the step relative to the crosspiece and the rest of the ladder.

Ribs 207 and 208 may also be provided on the edges of the slot for retaining the base and consequently the step in position on the crosspiece. The distance D between the crests of the ribs 207 and 208 exceeds the width of the crosspiece and permits the engagement of the latter in the slot. When the step has been placed in position, the weight of the step causes a slight angular displacement of the latter relative to the crosspiece, so that corresponding surfaces of the crosspiece and base come into contact with one another and lock the step against rotation relative to the crosspiece.

Figure 19:
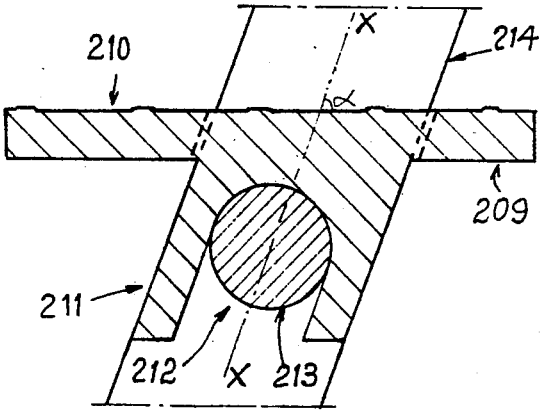
Figure 20:
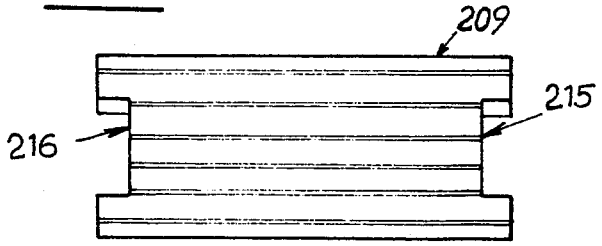

In another embodiment shown in FIGS. 19 and 20, the step 209 includes a bearing surface 210 for the user and a base 211 including a slot 212 in which is engageable a crosspiece 213 of a ladder having two uprights only the upright 214 of which is shown in FIG. 19.

As shown, the crosspiece has a circular section in this case and the means for locking the step in position relative to the rest of the ladder may be formed by recesses 215, 216 (FIG. 20) for receiving the uprights of the ladder provided on each side of the step 209, so as to prevent this step from rotating relative to the uprights.

The step is therefore placed in position or removed by inclining the step relative to the axis of the crosspiece.

In the two embodiments, a slot having an axis X—X which is angularly offset relative to the vertical is shown. Indeed, this axis X—X may make with the support surface of the step an angle $\alpha$ of between 65° and 75° and ensure a correct positioning of the ladder when the latter is in use. Indeed, the users are obliged, if the steps are to be contained in a roughly horizontal plane, to dispose the ladder in such manner that the latter makes with the ground an angle of between 65° and 75°, which is a correct position of utilization of a ladder.

It will of course be understood that other embodiments may be envisaged and that the sections of the crosspieces may be different from the sections shown in the Figures.

The step may be constructed from any suitable material, such as for example aluminium, and be adaptable to constructions other than ladders, such as for example the uprights of scaffolding.

What is claimed:

1. A single ladder comprising at least two axially adjacent modular elements;

an upper element of said elements comprising two spaced-apart uprights, at least one crosspiece extending between and interconnecting the uprights, the uprights having at least a lower screw-threaded end;

a lower element of said two elements comprising two spaced-apart uprights, at least one crosspiece extending between and interconnecting the uprights of said lower element, the uprights of said lower element having upper screw-threaded ends;

at least two tapped fixing rings screw-threadedly engaged on the lower screw-threaded ends of the two uprights of said upper element and screw-threaded engaged on the upper screw-threaded ends of said lower element and thereby coupling together the uprights of said upper element and said lower element; and foot means mounted on lower ends of the uprights of said lower element; and wherein said foot means comprise a support bar having two openings, two bolts extending through said openings, means defining tapped cavities provided at lower ends of the uprights of said lower element, the bolts being screw-threadedly engaged in said cavities for fixing the bar to said lower element, a tapped sleeve provided at each end of the bar, and a screw-threaded rod, screw-threadedly engaged in said tapped sleeve and a support shoe provided at a lower end of each rod for adapting the foot means to the configuration of the ground.

2. A ladder according to claim 1, wherein actuating means are provided at the end of each screw-threaded rod remote from said shoe.

3. A ladder according to claim 1, wherein the means defining the tapped cavities are constituted by inner tapped portions of a ring screwed on screw-threaded ends of the uprights of said lower element.

4. A single ladder comprising at least two axially adjacent modular elements;

an upper element of said elements comprising two spaced-apart uprights, at least one crosspiece extending between and interconnecting the uprights, the uprights having at least a lower screw-threaded end;

a lower element of said two elements comprising two spaced-apart uprights, at least one crosspiece extending between and interconnecting the uprights of said lower element, the uprights of said lower element having upper screw-threaded ends;

at least two tapped fixing rings screw-threadedly engaged on the lower screw-threaded ends of the two uprights of said upper element and screw-threadedly engaged on the upper screw-threaded ends of said lower element and thereby coupling together the uprights of said upper element and said lower element; and foot means mounted on lower ends of the uprights of said lower element; and wherein the foot means comprise two tapped rings screw-threadedly engaged on lower screw-threaded ends of the uprights of said lower element and shoes fixed to said two tapped rings for bearing on the ground.

5. A ladder according to claim 4, wherein the shoes are articulated to the rings.

6. A multiple ladder comprising at least two single ladders, each of said single ladders comprising a single ladder comprising at least two axially adjacent modular elements;

an upper element of said elements comprising two spaced-apart uprights, at least one crosspiece extending between and interconnecting the uprights, the uprights having at least a lower screw-threaded end;

a lower element of said two elements comprising two spaced-apart uprights, at least one crosspiece extending between and interconnecting the uprights of said lower element, the uprights of said lower element having upper screw-threaded ends;

at least two tapped fixing rings screw-threadedly engaged on the lower screw-threaded ends of the two uprights of said upper element and screw-threadedly engaged on the upper screw-threaded ends of said lower element and thereby coupling together the uprights of said upper and lower element; and foot means mounted on lower ends of the uprights of said lower element; and said multiple ladder further comprising two articulation means interconnecting upper ends of the uprights of said upper elements of the two single ladders.

7. A multiple ladder according to claim 6, wherein each articulation means comprises two half-shells pivotally mounted on each other and comprising on confronting surfaces thereof projecting portions and recesses defining stable positions of the two half - shells relative to one another, said half-shells each comprising a branch having a screw-threaded portion and tapped fixing rings screw-threadedly engaged on the screw-threaded portions of the branches and fixing the branches to the uprights of said upper elements of said single ladders.

8. A multiple ladder according to claim 7, wherein said two branches of each articulation means comprise spigots for centering and positioning the branches of the articulation means in cavities in the uprights of said upper elements of said single ladders.

9. Scaffolding comprising two substantially vertical planes of assembled elements arranged one above the other in each plane, a substantially horizontal work plane and articulation means interconnecting the work plane and said element.

each of said elements comprising at least two spaced-apart uprights at least one crosspiece extending between and interconnecting said uprights, each upright having opposite screw-threaded ends, and tapped fixing rings screw-threadedly engaged on and interconnecting adjacent ones of the screw-threaded ends of the uprights of the assembled elements.

10. Scaffolding according to claim 9, wherein each articulation means comprises two half shells each having a respective branch and rotatively mounted with respect to each other and comprising, on confronting surfaces of the half-shells projecting portions and recesses defining a stable position of the two branches, in which position the branches make an angle of substantially 90° therebetween, one of said branches having a screw-threaded portion screw-threadedly engaged with a plate, said scaffolding further comprising a work platform in said substantially horizontal plane, said plate adapting and fixing said work platform to the uprights of an upper one of said elements in said substantially vertical plane.

11. Scaffolding according to claim 10, comprising means defining a guard-rail around the platform and a filing member associated with each articulation means, the projecting portions of the articulation means comprising a recess for the passage and the fixing of a portion of said fixing member for fixing the means defining a guard-rail to the rest of the scaffolding.

12. Scaffolding according to claim 10, wherein the adaptation plate comprises two openings adapted to receive the corresponding branches of the articulation means, the screw-threaded portion of said branches projecting from the side of the plate remote from the articulation means and being adapted to cooperate with means for fixing the plate on the articulation means.

13. Scaffolding according to claim 12, wherein the adaptation plate comprises two projecting pins including screw-threaded portions screw-threadedly engaged with tapped fixing rings of a modular element supporting a floor of the work platform.

14. Scaffolding according to claim 13, wherein said projecting pins include spigots for centering and positioning the support elements of the floor.

15. Scaffolding according to claim 11, wherein each fixing member includes a screw-threaded portion screw threadedly engaged with a tapped fixing ring for fixing the means constituting a guard-rail to the rest of the scaffolding.

16. Scaffolding according to claim 13, wherein the modular element supporting the work platform comprises telescopic crosspieces permitting the adaptation of the distance between the uprights of the modular element supporting the work platform.

17. Scaffolding according to claim 16, wherein the cross-pieces of the modular element supporting the work platform comprise a rod adapted to be engaged in two tubular cross-piece portions in a telescopic manner, means for locking in position being provided for locking the assembly of the rod and crosspiece portions.

18. Scaffolding according to claim 13, further comprising modular floor elements including locking means cooperative with said floor support element and in bearing relation to said floor support element.

19. Scaffolding according to claim 18, wherein said locking means are formed by laterally projecting portions on each side of the respective floor modular element.

20. Scaffolding according to claim 18, wherein the locking means comprise spigots disposed under the respective floor modular element, said spigots being cooperative with crosspieces of the floor support element.

21. Scaffolding according to claim 9, comprising telescopic stiffening means extending between the uprights of said two substantially vertical planes, and locking means for said stiffening means for locking them into an assembly.

22. Scaffolding according to claim 9, comprising foot means, substantially vertical planes of uprights, floor support means, and means forming a guard-rail, each of said means comprising screw-threaded portions, and tapped fixing rings screwthreadedly engaged on said screw-threaded portions for fixing said means to at least one adjacent means.

23. At least two modular constructional elements in assembled adjacent relation to each other, each modular element comprising at least two spaced-apart uprights, at least one crosspiece extending between and interconnecting the uprights, the uprights each having screw threaded opposite ends, tapped fixing rings screw-threadedly engaged with adjacent screw-threaded ends of the uprights of the two elements for coupling said uprights, one of the screw threads engaged by each ring having a length equal to at least the length of the ring to allow the ring to be substantially completely screwed onto said one screw thread and allow the respective uprights to be substantially fully assembled before subsequently partly unscrewing the ring from said one screw thread onto the other screw-thread of said threads engaged by the ring and thereby coupling together the respective uprights.

24. At least modular constructinal elements according to claim 23, wherein the other of said screw threads engaged by each tapped ring has a length no greater than substantially one half of the length of the tapped ring whereby to allow the tapped ring to be jammed into a fixed position at the end of said other screw thread when the ring has coupled the respective two screw-threaded ends of the respective uprights.

25. At least two modular constructional elements according to claim 23, further comprising axial spigots extending from screw-threaded ends of the uprights of one of said modular elements, and axial cavities in screw-threaded ends of the uprights of the other of said modular elements, in which cavities said spigots are engaged for centering and positioning the screw-threaded ends of the respective uprights.

* * * * *